US005502868A

United States Patent [19]

Bräendle

[11] Patent Number: 5,502,868

[45] Date of Patent: Apr. 2, 1996

[54] PROCESS AND DEVICE FOR CLEANING OF SURFACES

[75] Inventor: Ruedi Bräendle, Mosnang, Switzerland

[73] Assignee: Bräendle Metallbau AG, Mosnang, Switzerland

[21] Appl. No.: 262,155

[22] Filed: Jun. 20, 1994

[30] Foreign Application Priority Data

Jul. 1, 1993 [CH] Switzerland ..... 01978/93

[51] Int. Cl.[6] ..... A47L 1/06

[52] U.S. Cl. ..... 15/321; 15/345; 15/302; 134/182

[58] Field of Search ..... 134/182, 200, 134/172; 15/302, 321, 320, 345

[56] References Cited

U.S. PATENT DOCUMENTS 2,797,530 7/1957 Garver .
4,670,062 6/1987 Lester .
4,782,844 11/1988 Hughes .
4,791,947 12/1988 Holzberger .
5,024,246 6/1991 Bain .

FOREIGN PATENT DOCUMENTS 1-182457 7/1989 Japan .

*Primary Examiner*—Frankie L. Stinson
*Attorney, Agent, or Firm*—McAulay Fisher Nissen Goldberg & Kiel

[57] ABSTRACT

For the purpose of blast-cleaning surfaces, in particular facades, a cleaning process and accompanying device have a working area with an air curtain and a suction device. The working area is tightly connected with the surface on one side via a contact opening and on the other side has a work opening through which the cleaning personnel can guide the cleaning jet nozzle while maintaining visual contact with the surface to be cleaned. The air curtain is formed along the work opening in such a way that no dust or blasting material can escape through the work opening from the working area.

16 Claims, 3 Drawing Sheets

PROCESS AND DEVICE FOR CLEANING OF SURFACES

BACKGROUND OF THE INVENTION a) Field of the Invention

The invention is directed to a process for cleaning surfaces by means of at least one particle-removing work implement and to a device for carrying out the process.

b) Description of the Related Art

Facades which are soiled by environmental influences such as deposited soot particles or which are covered with unwanted layers of paint are cleaned by methods of mechanical abrasion, preferably by dry blasting. The blasting material is preferably composed of minute round flexible beads of glass which are sprayed onto the surface to be cleaned with a slight spin so as to eradicate the layer of dirt. The blasting material and dirt particles are sucked out by a vacuum system and fed to a dust extracting system which separates the blasting material from the dirt. In order to minimize the formation of dust and the release of blasting material into the surrounding area, blasting and suction are effected in an outwardly closed space whose unique open side tightly contacts the surface to be cleaned.

The cleaning personnel must monitor the blasting action so as to direct the blast onto the soiled regions until the desired degree of cleanliness is achieved. There are two known solutions for providing the visibility required for this monitoring. The first solution consists in providing a closed space which is sufficiently large to accommodate the cleaning personnel. In the second solution, the selected dimensions of the closed space are small enough to be held in the hand of the cleaning personnel and guided along the surface.

The first solution has the disadvantage that the work space for receiving the cleaning personnel which contacts the facade at its open side and is displaced from one area of the facade to another is very large and accordingly also extremely heavy. A crane truck is used to move along the facade, the work space being suspended from its boom. Because of technical factors relating to insurance, this type of suspended attachment for a manned work space is only permissible in conjunction with a special, very expensive crane truck. In addition, the high concentrations of dirt and blasting material in the work space constitute a danger to the eyes and breathing passages of the cleaning personnel. The health hazard can be reduced to a tolerable level only by wearing safety glasses, masks and protective suits. The safety measures do not provide complete protection and also impede work.

Visibility is substantially impaired when working in a closed work space due to the absence of sufficient daylight and due to the high proportion of dust. Owing to this lack of visibility, the cleaning results cannot be satisfactorily monitored. Another unsatisfactory aspect of a closed work space is the lack of direct communication to the outside, in particular to the crane truck. The required two-way communication systems can be employed only with poor results due to the high noise level in the work space. The isolation of the cleaning personnel in an extremely unpleasant working atmosphere is detrimental to work morale and accordingly undercuts the efficiency of the cleaning process. In addition, the closed working space necessitates high costs in equipment and personnel so that cleaning costs are very high.

The disadvantage of the second solution consists in that the closed space or working box containing the blasting nozzle or jet nozzle and suction connection must be held by hand and guided along the surface manually. The required freedom of movement along the surface prevents an adequate sealing at the open side against the surface so that dirt particles and blasting material escape, resulting in a threat to the environment and especially to the health of the personnel carrying out the cleaning. The impact of the blasting jet on the surface cannot be observed in the closed space so that it is not possible to control cleaning of soiled locations in a satisfactory manner. Also, the work box must first be shifted before the cleaning action can be inspected so that the cleaning process is very cumbersome.

OBJECT AND SUMMARY OF THE INVENTION

The primary object of the present invention is directed to a process and a device which enable efficient cleaning by providing the cleaning personnel with the required visual contact with the blasting jet and allowing them to manipulate the jet without at the same time exposing the environment or the cleaning personnel to increased concentrations of dirt and blasting material.

The inventive solution makes use of a treatment area or working area which has at least one exhaust opening and is at least partially open on one side contacting the surface to be cleaned to allow blast-cleaning and on a front enclosure surface opposite the surface to be cleaned so as to allow for manipulation and visibility. The working area is defined laterally by at least three, preferably four, lateral enclosure surfaces which are arranged transversely to the surface and to the front enclosure surface. On the contacting side, the escape of blasting material and dirt particles is prevented by a sealing device enclosing the opening on the contacting side and tightly adjoining the surface. In order to prevent particles from escaping from the work opening in the front enclosure surface, a gas flow is produced substantially parallel to the surface in at least a portion of the working area.

The gas flow preferably comprises at least one gas curtain or air curtain proceeding from an inlet device and extending in the region of the exhaust opening, at least one such exhaust opening being provided. The inlet device is arranged at least along one lateral enclosure surface, has at least one strip nozzle and/or a plurality of point nozzles and is fed by compressed gas, preferably compressed air. The arrangement of the inlet device and the exhaust opening, of which there is at least one, is selected in particular in such a way that the air curtain extends along the front enclosure surface and closes the work opening to prevent the escape of air located between the curtain and contact surface.

To prevent turbulence or whirling and a long dwelling period of dirt particles and blasting material in the working area, a blasting material suction flow is preferably produced between the air curtain and the surface to be cleaned or contacting side. This flow is already at least partially present due to the entering cleaning jet and the suction, but is preferably intensified or homogenized by the influx of additional air or secondary air and, when appropriate, also by injected gas, in particular compressed air. The ideal flow pattern presents a unique main direction of flow substantially parallel to the surface, substantially throughout the entire working area. Large-volume whirling with appreciable backflow must be avoided. The flow velocity is at a maximum in the center of the air curtain and decreases toward the surface in the intervening space.

Naturally, the flow in the outlet or jet region of the cleaning jet is aligned substantially only in the blasting direction. However, this actually amounts to a local disturbance of the general flow in the working area. For the purpose of cleaning, the cleaning jet is directed against the surface. The jet flow is destroyed already after bouncing off the surface and the remaining local flow components and turbulence directed transversely to the throughflow of the working area are carried away by the general flow.

The air curtain and the parallel suction flow are formed by the interplay between the influx of compressed air and secondary air, if any, and the suction power and arrangement of the exhaust opening, of which there is at least one. To achieve the desired uniform flow pattern, the air, compressed air and/or secondary air flows into the working area in the region of a first lateral enclosure surface and is sucked out through at least one exhaust opening in the region of a second lateral enclosure surface, the first and second enclosure surfaces being arranged opposite one another. The suction volume throughput is so adjusted or so regulated, for example, by a regulating device, that it substantially always corresponds at least to the sum of the uncompressed volume input through the inlet device and the jet nozzle. But it is preferably at least occasionally greater so that it carries off secondary air. Secondary or false air can also enter between the sealing device enclosing the opening on the contacting side and the surface in the working area.

In order to regulate the flow in the working area, at least one physical magnitude, such as pressure, or a quantity depending on the concentration of blasting material is advisably detected by means of at least one sensor. There is a risk that a high concentration of particles and accordingly poor visibility will occur in a zone of the working area located near the surface at a distance from the exhaust opening, of which there is at least one, due to the weak suction flow. Effective visibility can be detected, e.g., by an optical sensor. Information concerning the flow situation is acquired by pressure measurements. The suction power and/or influx of secondary and/or compressed air can be regulated corresponding to the measured values.

As a result of the inventive use of a working area which is located in front of the surface to be cleaned and through which air flows, the cleaning personnel can guide the jet nozzle through the work opening into the working area without hindrance and can observe the effect of the cleaning jet at the same time. In so doing, neither personnel nor environment are harmed by the blasting material and/or dirt particles.

The required device for carrying out the process is light and can be fastened to a conventional lifting platform, e.g. a work scaffold which can be positioned within a broad area by means of a swivelable telescope arm for the purpose of cleaning facades. Since the working area is substantially vertical when cleaning facades, the air inlet device is preferably arranged at an upper lateral enclosure surface and the exhaust opening, of which there is at least one, is arranged at a lower lateral enclosure surface. In this way, the blasting material moves toward the exhaust opening, of which there is at least one, as a result of the flow in the working area as well as by the force of gravity.

The cleaning jet nozzle is supplied via a blasting-material line by a compressor located on ground level. A control line which leads from an actuating handle at the jet nozzle to the compressor is preferably provided for controlling the cleaning jet and compressor. The compressed air required for the air curtain and, as the case may be, for the blasting material suction flow is guided via a compressed-air line to the inlet device by the same compressor or by another compressor. Another line, preferably a flexible tube having a metal spiral and a plastic jacket, is provided for connecting the exhaust opening, of which there is at least one, with a suction unit arranged on the ground.

When using a device according to the invention in combination with a work platform which can be actuated from above ground, cleaning of facades can be carried out by one person working alone. The cost of labor and apparatus is extremely small. Apart from this economical advantage, the quality of the work environment is markedly improved over the known closed work spaces and the cleaning personnel will be more motivated.

Not only has a working area according to the invention proven advantageous, novel and inventive in combination with a cleaning jet, but a working area according to the invention with an air curtain and a suction device is also advisable for mechanical treatment of a surface in which particles are released, e.g., when the surface is sanded with belt sanders or disk sanders. In this way, dust is prevented from loading the environment and the personnel is protected.

The use of the process according to the invention is not limited to the cleaning of facades, but can also be used, for example, in workshops for cleaning the surfaces of workpieces while preventing the release of particles of dirt and/or blasting material into the workshop. The surface to be cleaned can be arranged on a contact surface or inside the working area. If it is arranged on the inside, a closed wall is provided instead of the contact opening. The working area is formed by a processing chamber with only one work opening. Known processing chambers are substantially completely closed toward the outside and only provide gloves which are fastened to hand openings and lead into the working area for handling the working implement. The freedom of movement of the cleaning personnel is severely restricted in these prior art devices. On the other hand, a working area according to the invention has the great advantage that manipulation through the work opening is restricted only very negligibly without substantial quantities of dust escaping from the processing space.

BRIEF DESCRIPTION OF THE DRAWINGS

In the drawings.

The drawing describes the invention with reference to an embodiment form shown schematically.

DESCRIPTION OF THE PREFERRED EMBODIMENTS

While the foregoing description and drawings represent the preferred embodiments of the present invention, it will be obvious to those skilled in the art that various changes and modifications may be made therein without departing from the true spirit and scope of the present invention.

Figure 1:
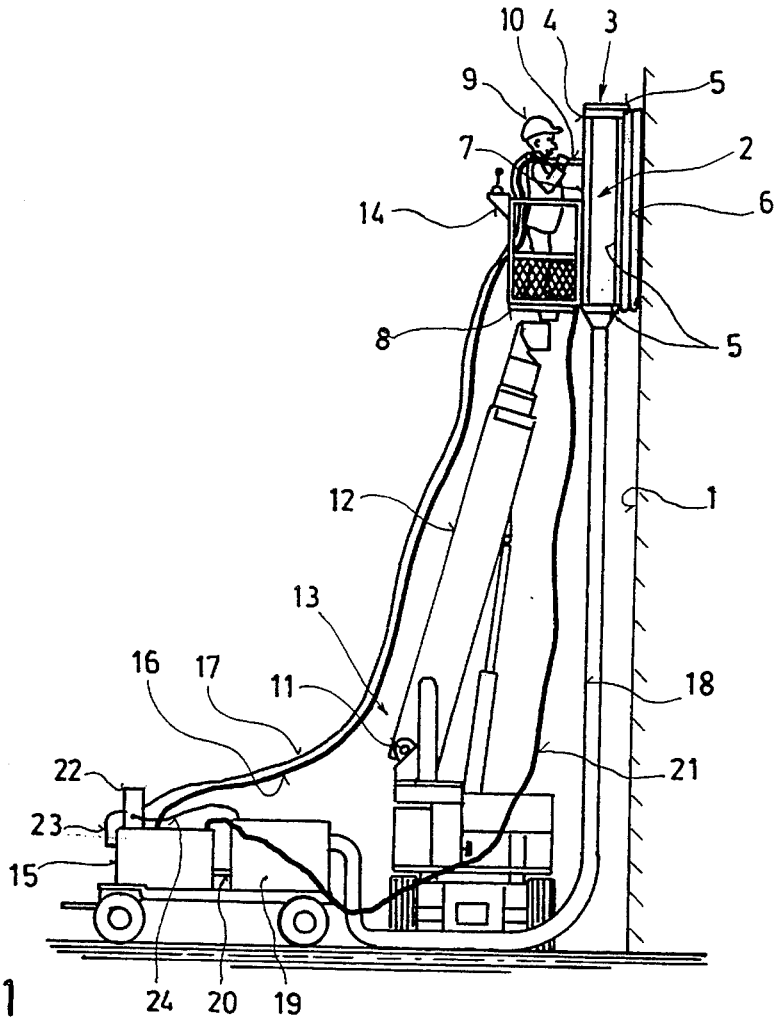
FIG. 1 shows a view of an arrangement with a vertically adjustable work platform including a facade connection part and with a compressor and a processing installation for blasting material used in dry blasting.

FIG. 1 illustrates the use of the process according to the invention for cleaning facades. A working area 2 in the shape of a parallelepiped adjoining a facade 1 is at least partially delimited by a housing 3. The housing 3 substantially comprises a frame 4 and lateral enclosure surfaces 5 which are attached thereto and aligned transversely to the facade, and at least one sealing element 6 which adjoins lateral enclosure surfaces and tightly contacts the facade. A work opening is provided in a front enclosure surface 7 of the housing 3 opposite the facade 1. The housing 3 is fastened at a movable work platform 8 from which the cleaning personnel 9 can purposefully direct a jet nozzle 10 or some other work implement through the work opening within the sealing element 6, of which there is at least one, onto the locations of the facade 1 to be cleaned.

The work platform 8 is preferably fastened at the free end of a telescopic arm 12 of a lifting device 13, the telescopic arm 12 being swivelable about a horizontal axis 11. The cleaning personnel 9 can adjust the position of the work platform 8 and accordingly the position of the working area 2 along the facade 1 via a control panel 14 and can clean the entire facade 1 by sections. The blasting material required for producing the cleaning jet is fed to the jet nozzle 10 via a blasting-material line 16 by compressed air by means of a compressor and blasting device 15 located in the vicinity of the lifting device 13. A control line 17 is arranged parallel to the line 16 and is connected with the compressor of the device 15 via a control unit 22 and compressor cable 23. The control line 17 enables the cleaning personnel 9 to regulate the compressor of the device 15 and accordingly the jet by means of an actuating element connected to the control line 17.

The blasting material is sucked out of the working area 2 into a recycling unit 19 through at least one exhaust opening arranged at the lower lateral enclosure surface 5 and through a flexible tube connected thereto. The recycling unit 19 substantially has a suction unit and a dust extracting device which separates the blasting material from the dust carried along with it. The blasting material passes through a line 20 from the recycling unit 19 to the device 15 for reuse in the cleaning jet.

A compressed-air line 21 leads from the compressor of the device 15 or, as the case may be, from a second compressor to the housing 3. The compressed air guided therein is used to form an air curtain and possibly to reinforce a blasting material suction flow in the working area 2. The control unit 22 is also connected with the recycling unit 19 via a connection cable 24 so that the suction power can always be adapted if necessary to the amount of supplied air.

Figure 2:
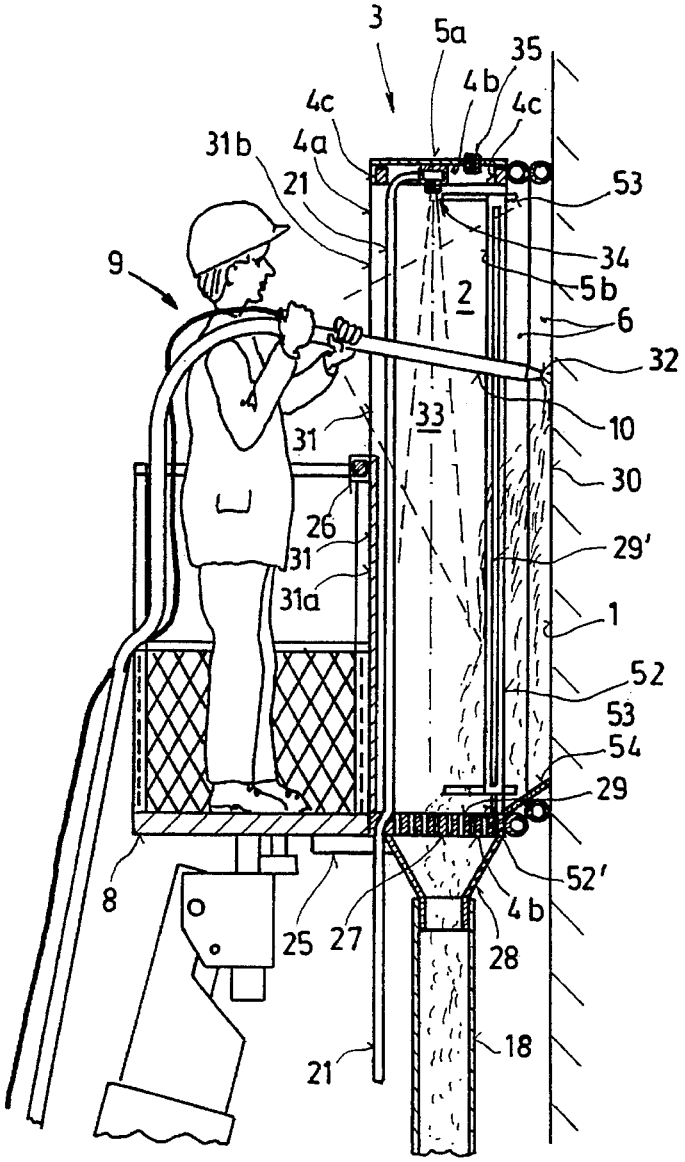
FIG. 2 shows a vertical section through the work platform and the working area.

According to FIG. 2, the housing 3 surrounding the working area 2 is fastened to the work platform 8 by connection members 25 and 26. The connection members 25, 26 are preferably constructed in such a way that the housing 3 can be attached and removed with a minimum of effort. Accordingly, the work platform 8 can also be used for other tasks without being modified. The housing 3 preferably has two lateral vertical frame parts **4*a* which adjoin the platform 8 and are connected at the upper and lower ends by frame parts 4*b* which are guided horizontally against the facade 1. Frame parts 4*c* which are aligned horizontally parallel to the facade 1 are provided between the upper parts and, as the case may be, between the lower parts 4*b*. Only one grate 27 and a funnel 28 attached thereto from below are provided between the lower parts 4*b*. Since the funnel 28 is connected to the flexible tube 18 and accordingly to the suction unit, the through-openings of the grate 27 form the exhaust openings 29. The grate 27** keeps large objects such as tools within the working area.

An upper enclosure surface **5*a* is attached via the upper frame parts 4*b* and 4*c*. Lateral enclosure surfaces 5*b* are arranged laterally at the frame parts 4*a* and 4*b* so that the working area 2 is defined laterally, at the top and at the bottom by wall parts 5*b*, 5*a* and 27. At least one sealing element 6 adjoins these wall parts on the side of the facade 1 around a contact opening 30 allowing access to a section of facade from the working area. The construction according to FIG. 2 comprises two round hollow profiles of resilient material such as rubber or plastic which are arranged adjacent to one another. An inclined seal face 54 is provided to prevent particles from settling on the seal 6 associated with the lower enclosure surface. However, it is preferable to use a sealing device 6** with at least one air chamber system which is supplied by compressed air and has at least one, but preferably two, feed openings and, when appropriate, at least one pressure relief valve to prevent the sealing element from splitting.

In order to achieve sufficient sealing on portions of the facade with substantial irregularities or unevenness, the air chambers close to the facade are less tautly inflated. In addition to different seal profiles, sealing elements incorporating bellows and/or thin plates and/or brushes can also be used so that the seal 6 tightly contacts the facade 1 around the contact opening 30 even on sharply curved portions of the facade, in particular on columns. Another advantageous construction of the sealing device 6 is described hereinafter with reference to FIG. 5.

In addition to the exhaust openings 29, at least one exhaust opening 29' can also be provided in the region of the lateral enclosure surfaces **5*b*. On at least one side of the contact surface 30, at least one suction duct 52 extending substantially parallel to the surface and having a slot opening 29' is preferably attached so as to be displaceable along the lateral enclosure surface at guide members 53. By providing exhaust openings 29, 29' substantially around the contact opening 30, it is possible to prevent large amounts of dust and blasting particles from escaping due to a poor sealing of the sealing device 6. Suction lines 52' lead from the suction ducts 52 to a connecting arrangement at the flexible tube 18 or directly to the recycling unit 19**.

The front enclosure surface 31 located opposite the contact opening 30 and facing the work platform is preferably closed at a lower region by a front plate **31*a*. In the upper region of the front enclosure 31, the work opening 31*b* is so disposed that the cleaning personnel 9 can guide the cleaning jet nozzle 10 over the facade 1 so as to have eye contact substantially within the entire region of the contact opening 30. A cleaning jet 32 strikes the facade and removes the unwanted layer. The blasting material and the dirt particles flow away from the facade 1 at least partially toward the exhaust openings 29** located at the bottom due to the suction and the force of gravity.

To prevent blasting material and/or dust from escaping through the work opening, an air curtain 33 is provided in the working area 2 directly within the work opening **31*b* across the entire width of the opening. This air curtain 33 is formed by the cooperation between an air inlet device arranged at the upper enclosure surface 5*a* and the suction exerted through the exhaust openings 29. The air inlet device comprises at least one strip nozzle 34 or a number of point nozzles which are arranged in a row and aligned substantially parallel to the work opening and produce an air flow directed downward along the front enclosure surface. The air nozzles 34 are supplied by the compressed-air line 21 which preferably extends along a frame part 4***a* in the housing 3 and may be constructed as venturi valves.

A blasting material suction flow which is as uniform as possible should be formed between the air curtain 33 and the contact opening 30, and not a flow structure with substantial whirling. To achieve this, secondary air and/or compressed air must be introduced into the region behind the air curtain 33 close to the facade. For example, at least one secondary-air opening 35 can be provided in the upper enclosure surface 5*a* to let in secondary air. The secondary-air opening 5*a* may be constructed as a pressure-reducing valve or can be adjusted via a secondary-air regulator.

Figure 3A:
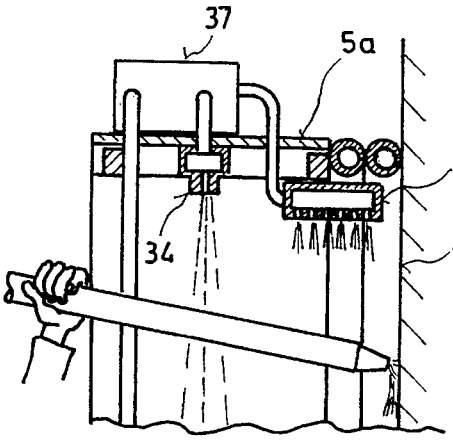
FIG. 3 shows a vertical section through the upper end region of the facade connection part.

In a construction according to FIG. 3*a*, the air inlet device also has at least one additional inlet nozzle 36 and a proportioning device 37 in addition to at least one air nozzle 34 for the air curtain 33. The inlet nozzle 36 is arranged in the region of the upper enclosure surface 5*a* between the air nozzle 34 and the contact opening and, in combination with the suction, excites a uniform suction flow of blasting material. For this purpose, the nozzle 36 can be formed by point nozzles or strip nozzles or as a surface nozzle, e.g. of porous material. A desired flow structure can be excited within the entire working area 2 by a suitable construction of the nozzles 34 and 36 and by appropriate distribution of the compressed air to the nozzles 34 and 36 by means of the proportioning device 37. In particular, a proportioning control can be provided for regulating the distribution depending on operation and is connected with the control unit 22 for this purpose, e.g. via the control line 17.

Figure 3B:
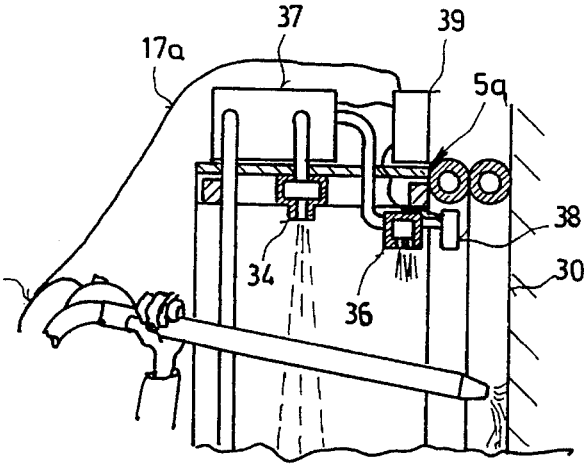

In the embodiment form according to FIG. 3*b*, at least one sensor 38 is provided between the air curtain 33 and the contact opening 30, preferably in the region of the upper enclosure surface 5*a*. This sensor 38 determines the pressure or preferably a magnitude depending on the particle concentration, in particular by means of optical measuring methods. The sensor is connected to an evaluating and control device 39 which is preferably connected in turn with the proportioning device 37 and possibly with the control unit 22 via a line 17*a* and 17. In this way the air input through the air nozzles 34 and 36 as well as the suction power and, in every case, the output of the jet nozzle can be changed automatically as a function of the value measured by the sensor.

Figure 4:
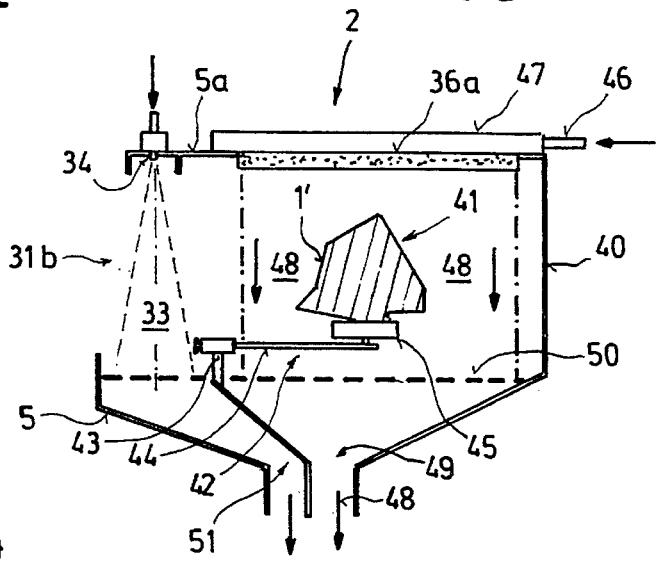
FIG. 4 shows a working area with closing wall and separate air circulation for the air curtain and the suction.

In another embodiment form according to FIG. 4, a surface 1' to be cleaned is arranged in the working area 2, rather than at a contact opening 30, and a closed wall 40 is connected to the lateral enclosure surfaces 5 rather than the contact opening 30 at the housing 3. The surface 1' is that of a workpiece 41 which is held by a holding device 42 in the working space 2. The holding device 42 preferably has an arm 44 which is fastened at one end via a guide device 43 at the housing 2 and, at the other end, carries a preferably rotatable fastening device 45 for fastening the workpiece 41. The workpiece 41 must be rotated in the working area so that every part on the surface of the workpiece 41 is accessible from the work opening 31*b*.

An inlet nozzle, preferably a surface nozzle 36*a* made of porous material, for example, is arranged above the workpiece 41 in the region of the surface 1' to be cleaned for supplying the suction flow 48. The surface nozzle 36*a* is supplied with gas, in particular compressed air, via a feed line 46 and a proportioning device 47. At least one first exhaust opening 49 is arranged preferably below a grate 50 in order to carry off the suction flow 48.

The air nozzle 34 is arranged at an enclosure surface 5 and at least one second exhaust opening 51 is arranged at an opposite enclosure surface 5 directly adjoining the work opening 31*b* in order to generate the air curtain. By connecting a second suction device to the second exhaust opening, it is possible to work with two substantially separate circulating flows. The first circulating flow carries dirt particles and, as the case may be, blasting material out of the working area 2 and the second circulating flow forms the air curtain. In this construction, the air of the air curtain need not be guided through the dust extracting installation and the two flows 33 and 48 can be excited in the working area 2 in different directions, in particular in opposite directions or substantially vertically relative to one another. In addition, different gases may be used for the two flows.

The two separate circulating flows can also be advantageously used in a construction without a closing wall 40. In the construction according to FIG. 4, the work opening 31*b* could also be provided in the upper enclosure surface 5*a* and the air curtain could be provided horizontally along this upper enclosure surface 5*a*. The first circulating flow could also be aligned horizontally. Accordingly, it will be seen that a number of inventive embodiment forms can be provided to adapt to the cleaning job in question.

Figure 5A:
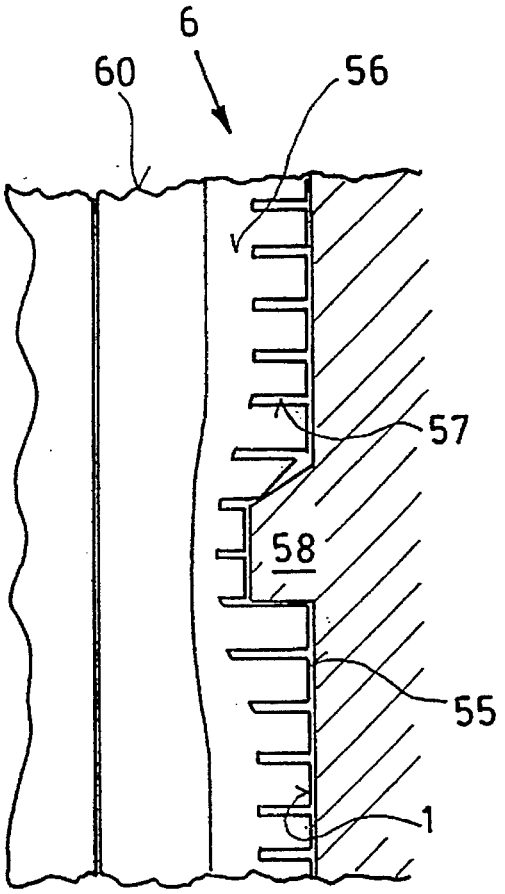
FIG. 5 shows a side view and a front view of a sealing device with projecting resilient connection projections.

FIG. 5 shows a preferred construction of the sealing device 6 which ensures a good sealing of the working area 2 toward the outside even in facades with a plurality of elements projecting out of the plane of the facade, e.g. molding and shoulders. The inventive idea underlying the solution consists in restricting the transmission of surface forces to small partial areas in the projecting contacting surface 55 of the sealing device 6. For this purpose a contacting layer 56 of foamed material against the contacting surface 55 must be divided into closely adjoining individual foamed-material projections 57 which can be compressed individually. No surface forces are transmitted between different projections 57 and the contacting surface 55 can accordingly adjoin the shoulders 58 of the facade in a discontinuous manner. If the contacting surface 55 were continuous, it would also maintain a continuous form over shoulders 58 projecting at right angles from the facade 1 so as to form gaps between the facade 1 and the sealing device 6 at both sides of such shoulders 58.

Figure 5B:
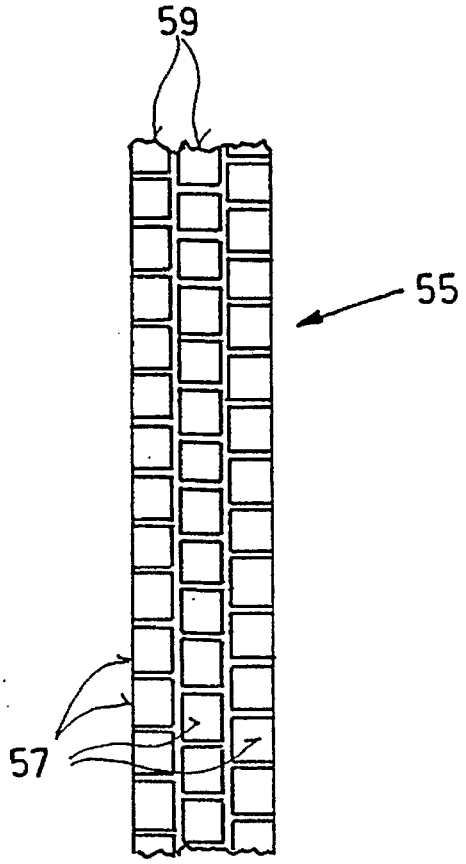

The projections 57 are arranged in at least one longitudinal strip or web 59 substantially along the sealing device 6 or around the contact opening. Since a projection 57 lying exactly in the region of a shoulder edge does not closely contact this edge, a plurality of longitudinal webs 59 are preferably arranged, as is shown in FIG. 5*b*, in such a way that the protruding projections 57 of different webs are offset relative to one another. The projections 57 of different webs 59 could also have different lengths in the longitudinal direction of the web. Due to the offsetting and the difference in length of the projections 57, projection sides occur at close intervals so that only small gaps, if any, will be formed as a result of shoulders.

The contacting layer 56 can also have a tubular construction. In so doing, a low pressure is built up in the interior so that the chamber-like projections 57 maintain the desired ability to deform. The contacting layer is preferably fastened to a tube member 60 associated with the sealing device 6, which tube member 60 is filled with compressed air, in particular under high pressure. Like the contacting layer 56, the tube member 60 can also be made up of different portions. A Velcro-type fastening system is preferably provided so that the contacting layer 56 may be exchanged easily. A Velcro fastening can also be provided for fastening the tube member 60, of which there is at least one, to the enclosure surface 5.

What is claimed is:

1. A cleaning device for carrying out a process for cleaning surfaces by at least one particle-removing work implement comprising:

a housing defining a working area;

at least one particle-removing work implement for cleaning a surface;

said housing being closed at least partially laterally toward the outside by at least three lateral enclosure surfaces aligned transversely to the surface; said housing accommodating the surface to be cleaned in a contacting region and having a working opening at least in a front enclosure surface located opposite the surface so that cleaning personnel can move the work implement through the work opening and within the working area while maintaining visual contact with at least a portion of the working area through the work opening;

at least one suction device being arranged at least in a partial area of at least one lateral enclosure surface; and a gas inlet device being arranged at least along a portion of a lateral enclosure surface and, in combination with a suction device, producing a gas flow substantially parallel to the front enclosure surface and which substantially prevents the emergence of particles from the working area in the region of the work opening.

2. A cleaning device for carrying out a process for cleaning surfaces by at least one particle-removing work implement comprising:

a housing defining a working area; said housing being closed at least partially laterally toward the outside by at least three lateral enclosure surfaces aligned transversely to the surface, said housing accommodating the surface to be cleaned in a contacting region and having a working opening at least in a front enclosure surface located opposite the surface;

at least one particle-removing work implement for cleaning a surface, the work implement comprising a jet nozzle which is connected to a first compressor and to a blasting material source for producing a cleaning jet of finely particulate blasting particles and gas, the gas inlet device being connected to a second compressor and having at least one gas delivery nozzle through which gas is injected into the working area under pressure, the at least one gas delivery nozzle being arranged at a first distance from the front enclosure surface substantially parallel to the front enclosure surface so as to produce a sheet-like gas curtain moving directly along the front enclosure surface;

at least one suction device being arranged at least in a partial area of at least one lateral enclosure surface; and, a gas inlet device being arranged at least along a portion of a lateral enclosure surface and, in combination with a suction device, producing a gas flow substantially parallel to the front enclosure surface and which substantially prevents the emergence of particles from the working area in the region of the work opening;

the working opening being positioned so that cleaning personnel can move the work implement through the work opening and within the working area while maintaining visual contact with at least a portion of the working area through the work opening.

3. The cleaning device according to claim 2, further comprising at least one second nozzle associated with the gas inlet device, said second nozzle being provided at least at a second distance from the front enclosure surface on the side of the gas curtain remote of the work opening in order to excite a particle suction flow, wherein the gas inlet device provides an adjustable proportioning device for adapting the gas flow through the first and second nozzles to one another and is constructed as a venturi valve.

4. The cleaning device according to claim 2, wherein the suction device has at least one funnel-shaped connection part which adjoins a lateral enclosure surface located opposite the gas inlet device, the connection part having a grate thereover and communicating with a suction unit through a suction tube, wherein suction power of the suction unit is adjustable and communicating with by a control device which is connected with the first compressor and with the second compressor so that the control device adjusts the suction power in such a way that it substantially always corresponds at least to the sum of the uncompressed volume input through the gas inlet device and the jet nozzle.

5. The cleaning device according to claim 4, wherein at least one sensor for sensing a physical quantity is arranged in the working area at a distance from the suction device, said sensor being connected with the control device so that the suction unit can be controlled as a function of at least one measurement value, and the control device and the adjustable proportioning device being connected in order to control the gas curtain and suction flow.

6. The cleaning device according to claim 2, wherein a first suction device is provided for sucking out dirt particles and blasting particles, if any, and a second suction device is associated with the gas curtain so that two separate circulating flows are formed in the working area in different directions, including in opposite directions.

7. The cleaning device according to claim 2 wherein the lateral enclosure surfaces have, in the region of a contacting side receiving the surface, resilient contacting elements to achieve a tight connection with the surface, said resilient contacting elements being positioned adjacent to each other.

8. The cleaning device according to claim 2 further comprising a closing wall, the closing wall being arranged on the side of the lateral enclosure surfaces located opposite the front enclosure surface to enclose the working area.

9. A cleaning device for cleaning a surface, said cleaning device comprising:

a housing having a front enclosure and a lateral enclosure, said front enclosure and said lateral enclosure being connected and defining a working area on and above the surface, said front enclosure having a work opening, said work opening providing physical and visual access to the working area;

said lateral enclosure being aligned substantially transversely relative to the surface and having first and second ports therein; and, said lateral enclosure being adapted to engage the surface to be cleaned;

at least one particle-removing work implement for cleaning the surface, said at least one particle-removing work implement being insertable into the work opening in the front enclosure, said at least one particle-removing work implement being moveable within the work opening in the front enclosure;

at least one suction device for removing debris from the first port in the lateral enclosure, the first port being located at a first position in the lateral enclosure; and, a gas inlet device for supplying gas to the work area through the second port in the lateral enclosure;

said gas inlet device and said suction device cooperating to supply a gas flow substantially parallel to the surface to be cleaned and which substantially prevents the emergence of debris from the working opening.

10. The cleaning device according to claim 9, wherein the work implement comprises a jet nozzle which is connected to a first compressor and to a blasting material source and produces a cleaning jet of finely particulate blasting particles and gas, the gas inlet device being connected to a second compressor and having at least one gas delivery nozzle through which gas is injected into the working area, the at least one gas delivery nozzle being arranged at a first distance from the front enclosure surface so as to produce a sheet-like gas curtain moving substantially parallel to the surface to be cleaned.

11. The cleaning device according to claim 10, wherein the second port is constructed in a funnel-shape and is connected to the lateral enclosure surface at a position opposite to the first port, the second port having grate thereover and communicating with a suction unit through a suction tube, wherein suction power of the suction unit is adjustable by a control device which is connected with the first compressor and with the second compressor so that the control device adjusts the suction power in such a way that it substantially always corresponds at least to the sum of the uncompressed volume input through the gas inlet device and the jet nozzle.

12. The cleaning device according to claim 11, wherein at least one sensor for sensing a physical quantity is arranged in the working area at a distance from the suction device, said sensor being connected with the control device so that the suction unit can be controlled as a function of at least one measurement value, and the control device and the adjustable proportioning device being connected in order to control the gas curtain and suction flow.

13. The cleaning device according to claim 9, further comprising at least one second nozzle associated with the gas inlet device, said second nozzle being provided at least at a second distance from the front enclosure surface on the side of the gas curtain remote of the work opening in order to excite a particle suction flow, wherein the gas inlet device provides an adjustable proportioning device for adapting the gas flow through the first and second nozzles to each other and is constructed as a venturi valve.

14. The cleaning device according to claim 10, wherein a first suction device is provided for sucking out debris and a second suction device is associated with the gas curtain so that two separate circulating flows are formed in the working area in different directions.

15. The cleaning device according to claim 9 wherein the lateral enclosure surface has, in the region of a contacting side receiving the surface, resilient contacting elements to achieve a tight connection with the surface, said resilient contacting elements being positioned adjacent to each other.

16. The cleaning device according to claim 9 further comprising a closing wall, the closing wall being arranged on the side of the lateral enclosure surface located opposite the front enclosure surface to enclose the working area.

* * * * *